US006349437B1

(12) United States Patent
Horning

(10) Patent No.: US 6,349,437 B1
(45) Date of Patent: Feb. 26, 2002

(54) BODY SUPPORT

(76) Inventor: Christopher T. Horning, 137 Cross St., Yorkville, NY (US) 13495

( * ) Notice: Subject to any disclaimer, the term of this patent is extended or adjusted under 35 U.S.C. 154(b) by 0 days.

(21) Appl. No.: 09/426,278

(22) Filed: Oct. 25, 1999

(51) Int. Cl.[7] ..... A47G 9/00
(52) U.S. Cl. ..... 5/632; 636/646; 636/648
(58) Field of Search ..... 5/630, 632, 652, 5/636, 646, 648; D6/601

(56) References Cited

U.S. PATENT DOCUMENTS

| | | | | |
|---|---|---|---|---|
| 4,624,021 | A | | 11/1986 | Hofstetter |
| 4,754,510 | A | | 7/1988 | King |
| 4,794,657 | A | | 1/1989 | Avery |
| 5,097,551 | A | | 3/1992 | Smith |
| 5,125,123 | A | | 6/1992 | Engle |
| 5,269,323 | A | | 12/1993 | Krouskop |
| D365,241 | S | * | 12/1995 | Braden et al. ..... D6/601 |
| 5,497,519 | A | | 3/1996 | Mintz |
| 5,573,014 | A | | 11/1996 | Ginter |
| 5,746,218 | A | | 5/1998 | Edge |

* cited by examiner

*Primary Examiner*—Lynne H. Browne
*Assistant Examiner*—Fredrick Conley
(74) *Attorney, Agent, or Firm*—Shook, Hardy & Bacon, LLP

(57) ABSTRACT

A body support for posturing the torso of a user lying in a fetal position to derive a therapeutic benefit while resting or sleeping. The device is arranged to engage the chin and the legs of the user so that the user's spine is held in an erect position. At the same time, arm grooves are provided in the support that enable the user to freely pass his or her arm through the upper section of the support and draw it against the user's chest, thus supporting the chest in an open position to promote ease of breathing and free circulation of blood through the upper torso.

9 Claims, 3 Drawing Sheets

BODY SUPPORT

FIELD OF THE INVENTION

The present invention relates to a full body support designed to posture a user's entire body while user is lying in a fetal position.

BACKGROUND OF THE INVENTION

Chiropractic literature and prior art related to therapeutic pillows are overflowing with research studies identifying the connection between proper body alignment and body stiffness and muscle strain. The fetal position has been found to be the best position for supporting the body while sleeping or resting. As such, there are a number of pillows available to promote proper musculo-skeletal alignment in the user, including leg pillows, knee pillows, torso pillows, and full body pillows. The prior art, however, suffers from a variety of drawbacks and deficiencies. Although there are pillows available which restrict the movement of the user's knees from side to side, there are no pillows available to restrict the up and down movement of the user's knees. In addition, there are no full body pillows available to prevent the user's head from dropping forward, thus, they do not address muscle tension of the neck and upper back region. Furthermore, none of the prior art teaches a full body pillow which supports the user's chin and head in addition to holding the chest area more open and not allowing for the user's knees to become misaligned while the user is lying in a fetal position. The present invention attempts to overcome the deficiencies in the prior art by providing a full body support arranged to engage various parts of the user's torso and hold the torso in the most beneficial posture while the user is resting or sleeping in a fetal position.

SUMMARY OF THE INVENTION

It is, therefore, a primary object of the present invention to improve body supports and, in particular, full length body support suitable for use while resting or sleeping.

It is a further object of the present invention to provide a full length body support that restricts the up and down movement of the user's body.

Yet another object of the present invention is to provide a full length body support that prevents the user's head from moving about, thus reducing muscle tension in the neck and back region.

Another object of the present invention is to promote the flow of blood to the chest and limbs of a person using a body support for physiologic and/or psychologic reasons.

The present invention is designed to be used by a person lying in a fetal position, that is, lying on one's side with knees drawn up towards the chin and arms drawn towards the chest. The subject device supports the bottom of the user's chin, thereby keeping the user's head from dropping forward, thus reducing muscle tension in the neck and upper back. The upper section of the support is meant for the user to hug with his arms and, thus, keeps the user's arms from falling together and holding the user's chest in an open position, and consequently, relieving muscle pulling and straining in the upper to middle back and promoting ease of breathing and free circulation of blood through the chest region. Further, generously grooved side walls keep the pillow from pinching the inner arm, thus reducing the chance of one's arms from falling asleep. The lower section of the support contains leg receiving grooves that keep the users legs and knees from moving up or down, thus properly aligning the user's hips and back.

BRIEF DESCRIPTION OF THE DRAWING

For a better understanding of these and other objects of the present invention, reference will be had to the following detailed description of the invention which is to be read in association with the accompanying drawings, wherein.

DETAILED DESCRIPTION OF THE INVENTION

Figure 1:
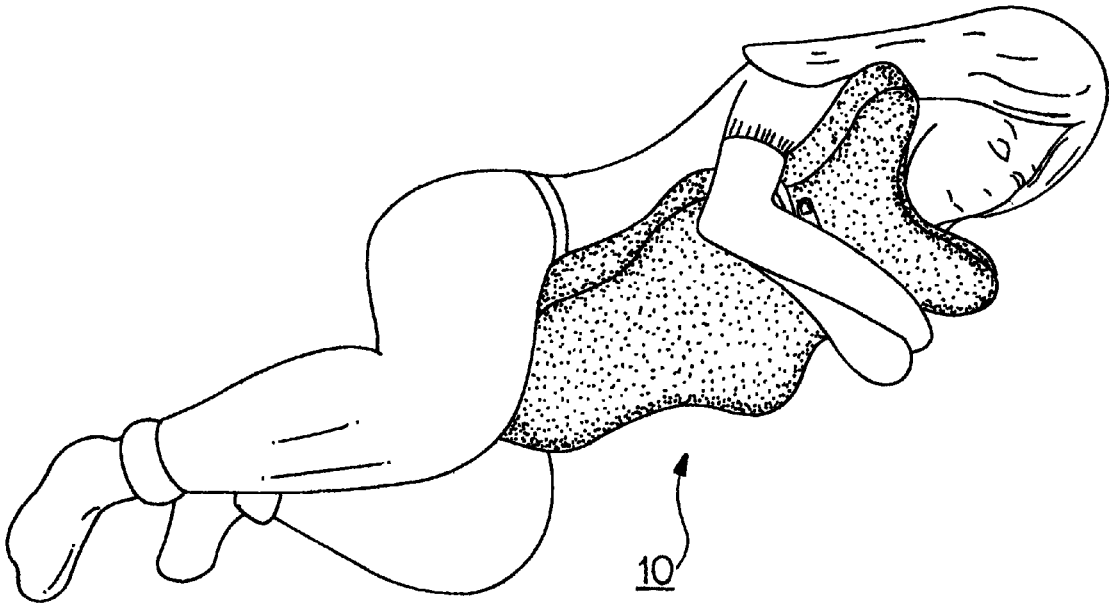
FIG. 1 is a perspective view of a body support embodying the teachings of the present invention, further illustrating the support being used by a person lying in a fetal position.

Referring now to the drawings, there is illustrated a body support, generally referenced 10, that embodies the teachings of the present invention. FIG. 1 shows the support being employed by a person lying in a fetal position which, for both physiologic and psychologic reasons, is recognized as the best position for sleeping or resting. In this position, the person lies upon his side with the knees drawn up. However, as humans mature and put on weight, it becomes more difficult to maintain a truly beneficial fetal position and a person lying in this position can experience difficulty and discomfort for a number of reasons. For example, the chest region of the torso generally closes as the shoulders come together producing back and muscle aches. Similarly, the knees generally become extended or retracted, thus allowing the spine to move out of an erect and thus beneficial posture. Lastly, the person's head being unsupported usually sags or drops down upon the chest causing severe neck pain and further spinal misalignment. As will become apparent from the disclosure below, the present invention is designed to support the body of the user in a true flat position during periods of rest and sleep.

The present body support is molded from a resilient self-supporting material that will retain its general shape unless otherwise deformed by some outside force. Once deformed, the body support will return to its original shape when the deforming force is released. Although the body support may be fabricated of any suitable resilient material, it is preferably molded from a closed cell polyurethane foam having a smooth outer surface that can resist dirt and be easily cleaned. For sanitary purposes, the body support is further equipped with a tight fitting contoured cover 12 formed of a washable fabric. Although not shown, the cover includes a side opening closure that is designed to facilitate easy mounting and removal of the cover.

Figure 2:
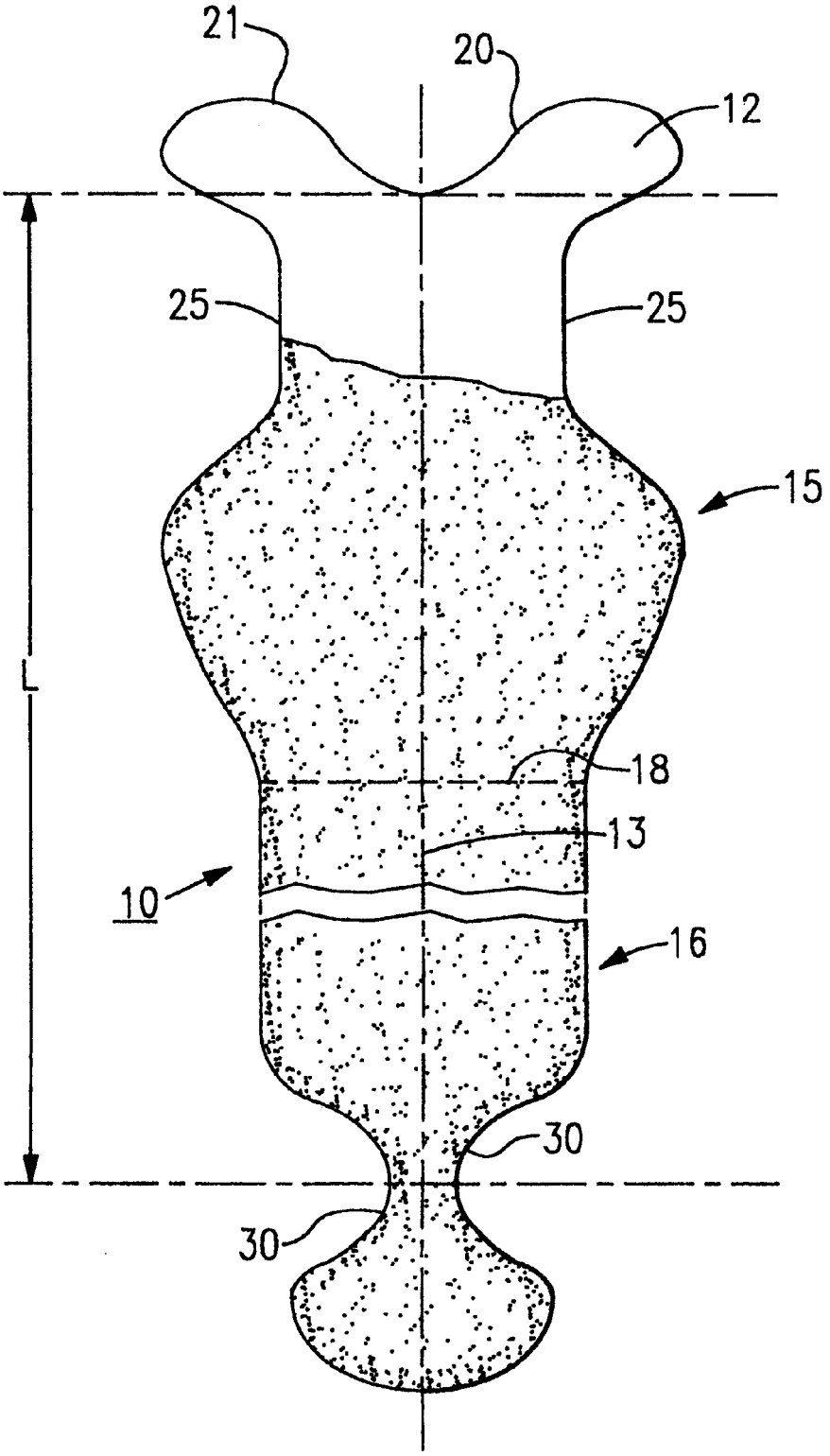
FIG. 2 is a top view of the body support illustrated in FIG. 1.
Figure 3:
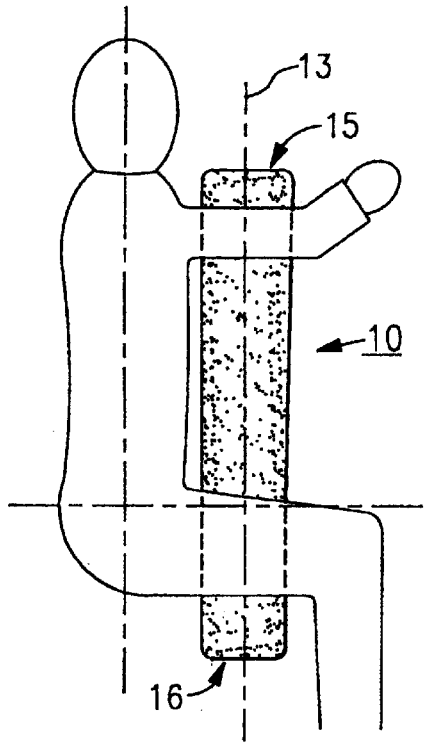
FIG. 3 is a side elevation showing the body support embodying the teachings of the present invention having a straight configuration.
Figure 4:
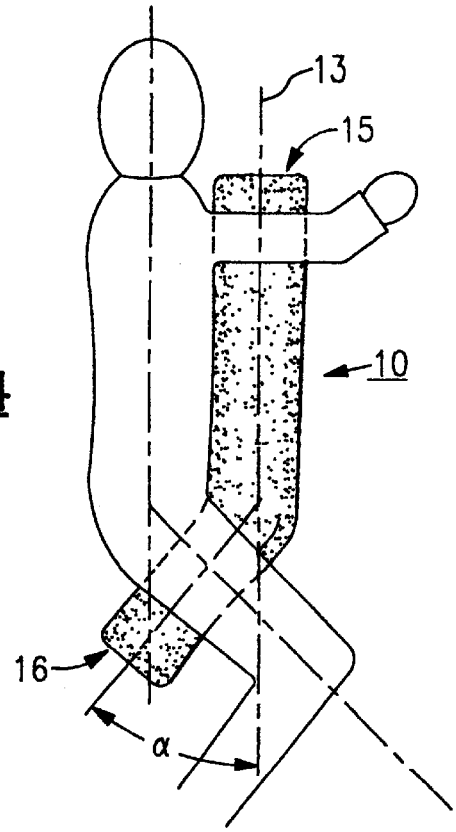
FIG. 4 is a second side elevation of the present body support having a bent configuration.

As shown in FIGS. 3 and 4, the body support has a substantially uniform thickness along its entire length and is symmetrical about a central axis 13 (FIG. 2). Although the support can be molded from a single piece of material, it is preferable to mold the support in two sections which are a top section 15 and a bottom section 16. The back and front walls of the two sections are generally parallel and coplanar. The two sections are joined together in assembly along a common joint line 18. The joint can be formed thermally using any well-known thermal welding techniques or by use of any suitable epoxy adhesive. The top section of the support is made in one standard size while the bottom section is made in varying lengths. Accordingly, the overall length of the support can be easily manufactured to accommodate people having varied torso lengths using a minimum number of manufacturing steps.

The top section 15 of the support includes a concave chin rest 20 that is centered in the top wall 21 of this section. A pair of opposed axially elongated arm grooves 25—25 are formed in the side walls of the top section through which the user can extend his or her arms to embrace the upper part of the support as illustrated in FIG. 1. The depth of the grooves are such that the user's lower arm can pass freely through the groove without having to feel the weight of the support. The axial length of the arm grooves is sufficiently long enough to accommodate upper body torsos of varying length. The side walls of the top section tapers inwardly from just below the arm groove and join the side walls of bottom section at the joint line 18.

The bottom section 16 of the body support is of substantially uniform width along its axial length and contains a pair of leg grooves 30—30 in its opposed side walls. The leg grooves are generally arcuate in form and are designed to snugly hold the legs of the user when in a fetal position. Accordingly, the knees of the user are prevented from moving up or down along the body support when the support is engaged as illustrated in FIG. 1.

The distance between the chin rest 20 and the leg grooves (L) is matched to the user's body length so that when the body support is embraced by a person lying in a fetal position as shown in FIG. 1, the body of the user is held in a desired alignment that is not only therapeutic, but also comfortable. First, the user's chin is well supported and is prevented from sagging or dropping down against the chest. Secondly, the user's shoulders are placed in a flat position against the surface of the support, thus forcing the user's chest into an open position that is most beneficial for breathing and promoting the circulation of blood through the upper body. Thirdly, the user's arms are not required to bear the weight of the support and again, free circulation of blood is promoted through the arm. Fourthly, the user's legs and, in particular, the knees, are firmly held in the leg grooves preventing the legs and knees from shifting axially.

As noted above, by use of a modularized bottom section 16, the effective length (L) of the body support can be easily matched to the user's body size so that the spinal column is held in a straight or erect posture most beneficial to the user.

Turning now to FIGS. 3 and 4, by use of the modularized bottom section 16, the present body support can be further adjusted to accommodate a woman who is along in her pregnancy when support is most needed or even an obese person who cannot reap the full benefit of the straight support illustrated in FIG. 3. As shown in FIG. 4, the bottom section of the support can be turned laterally at an angle ($\alpha$) with the center axis 13 of the support so that the user's legs can comfortably engage the leg grooves while still allowing the chin to be seated within the chin rest. It has been found that an angle of about 135° will provide for the most comfort while still firnishing a beneficial result.

While the present invention has been particularly shown and described with reference to the preferred mode as illustrated in the drawing, it will be understood by one skilled in the art that various changes in detail may be effected therein without departing from the spirit and scope of the invention as defined by the claims.

What is claimed is:

1. A body support for posturing the torso of a person lying in a fetal position, said support includes:

a top section and a bottom section that are symmetrical about a common axial centerline, said top section having a thickness that is about equal to that of the bottom section and said section having parallel front and back walls, said top section includes an upper wall, and said top section containing a chin rest located along the upper wall of said top section and a pair of opposed arm grooves formed in opposite side walls thereof to a depth to allow the arms of a user to pass freely therethrough so that a user lying in a fetal position with the user's chin in said chin rest can wrap the arms about the top section and draw the front wall of the top section against the user's chest thereby opening the chest region, wherein said chin rest is an arcuate shaped indentation formed in said upper wall of the top section, and said bottom section containing a pair of opposed leg grooves formed in opposed side walls thereof of positioning the leg of a user a given axial distance from said chin rest such that the user's spine is supported in an erect position.

2. A body support for posturing the torso of a person lying in a fetal position, said support includes:

a top section and a bottom section that are symmetrical about a common axial centerline, said top section having a thickness that is about equal to that of the bottom section and said section having parallel front and back walls, wherein the bottom section has a width that is less than that of the top section and wherein opposite side walls of the top section taper inwardly below the arm grooves and join opposite side walls of the bottom section along a common line perpendicular to said centerline, and wherein the top section and the bottom section are formed separately and are bonded together along said common line, said top section includes an upper wall, and said top section containing a chin rest located along the upper wall of said top section and a pair of opposed arm grooves formed in opposite side walls thereof to a depth to allow the arms of a user to pass freely therethrough so that a user lying in a fetal position with the user's chin in said chin rest can wrap the arms about the top section and draw the front wall of the top section against the user's chest thereby opening the chest region, and said bottom section containing a pair of opposed leg grooves formed in opposed side walls thereof of positioning the leg of a user a given axial distance from said chin rest such that the user's spine is supported in an erect position.

3. The body support of claim 2, wherein said sections are cojoined by a thermal bond.

4. The body support of claim 2, wherein said sections are cojoined by an epoxy bond.

5. A body support for posturing the torso of a person lying in a fetal position, said support includes:

a top section and a bottom section that are symmetrical about a common axial centerline, wherein the axial centerline of the bottom section is angularly displaced from that of the top section said top section having a thickness that is about equal to that of the bottom section and said section having parallel front and back walls, said top section includes an upper wall, and said top section containing a chin rest located along the upper wall of said top section and a pair of opposed arm grooves formed in opposite side walls thereof to a depth to allow the arms of a user to pass freely therethrough so that a user lying in a fetal position with the user's chin in said chin rest can wrap the arms about the top section and draw the front wall of the top section against the user's chest thereby opening the chest region, and said bottom section containing a pair of opposed leg grooves formed in opposed side walls thereof of positioning the leg of a user a given axial distance from said chin rest such that the user's spine is supported in an erect position.

6. The body section of claim 5, where the axial centerline of the bottom section is displaced at an angle of about 135° from that of the top section.

7. A body support for posturing the torso of a user lying in a fetal position, said support comprising:

a top section and a bottom section, said top section having front and back walls, said front and back walls spaced from one another at a portion of the periphery of said top section, wherein said top section includes an upper wall and a chin rest located along said upper wall, and wherein said chin rest is an arcuate shaped indentation formed in its upper wall;

a pair of opposing side walls extending between said front and back walls at said portion, and a pair of opposing arm grooves formed in said opposing side walls to a depth to allow the arms of the user to pass freely therethrough so that the user can wrap the user's arms about the top section and draw the front wall of the top section against the user's chest thereby opening the chest region, and said bottom section containing a pair of opposed leg grooves formed in opposed side walls thereof of positioning the leg of a user a given axial distance from said chin rest such that the user's spine is supported in an erect position.

8. A body support for posturing the torso of a user lying in a fetal position, said support comprising:

a top section and a bottom section, said top section having front and back walls, said front and back walls spaced from one another at a portion of the periphery of said top section, wherein said top and bottom sections have a common axial centerline, and wherein said axial centerline of said bottom section is angularly displaced from said top section;

a pair of opposing side walls extending between said front and back walls at said portion, and a pair of opposing arm grooves formed in said opposing side walls to a depth to allow the arms of the user to pass freely therethrough so that the user can wrap the user's arms about the top section and draw the front wall of the top section against the user's chest thereby opening the chest region.

9. The body support of claim 8, wherein said axial centerline of said bottom section is displaced at an angle of about 135° from that of said top section.

* * * * *